United States Patent [19]

Otten

[11] 4,143,749

[45] Mar. 13, 1979

[54] TOTALIZER FOR VENDING MACHINE

[75] Inventor: David M. Otten, Newton, Mass.

[73] Assignee: International Totalizing System, Newton, Mass.

[21] Appl. No.: 748,113

[22] Filed: Dec. 6, 1976

[51] Int. Cl.[2] ..... G07F 9/00

[52] U.S. Cl. ..... 194/1 N; 194/DIG. 3

[58] Field of Search ..... 194/1 R, 1 N, 1 M, 1 L, 194/10, 2, DIG. 3

[56] References Cited

U.S. PATENT DOCUMENTS

| | | | |
|---|---|---|---|
| 3,323,626 | 6/1967 | Abe et al. | 194/1 N |
| 3,815,718 | 6/1974 | Singer | 194/1 N |
| 3,894,220 | 7/1975 | Levasseur | 194/1 N X |
| 3,895,738 | 7/1975 | Buchanan et al. | 222/26 |
| 4,008,792 | 2/1977 | Levasseur et al. | 194/1 N |

*Primary Examiner*—Joseph J. Rolla
*Attorney, Agent, or Firm*—Donald Brown

[57] ABSTRACT

A totalizer for recording the income of a multiprice vending machine, the totalizer including a device to determine the value of the item selected, the fact that a sale was made, and a counter to total the value of all items selected. The totalizer preferably verifies the correctness of the value of the item selected to prevent erroneous counts and also preferably generates a coded output signal representing the price line of the vending machine providing information.

13 Claims, 2 Drawing Figures

TOTALIZER FOR VENDING MACHINE

BACKGROUND OF THE DISCLOSURE

Multiprice coin operated vending machines have long been a part of everyday life. Food, cigarettes, and various other items have been dispensed (vended) from such machines by the insertion of coins into a slot in the machine and the selection of the item desired by depressing a button or the like.

The normal procedure for collecting the proceeds from vending machines has been accomplished by periodic collections of the coins in the machine by a collector. While collection of the proceeds should supposedly directly relate to the amount of money taken in by the machine, in fact pilferage or machine malfunction e.g., dispensing of the wrong amount of change, may yield less cash to the machine owner than was actually taken in by the vending machine.

Accordingly, a need has developed to provide an up to date period balance of the cash collected by each vending machine so as to detect pilferage or machine malfunction as well as to speed up collections and reduce accounting time.

The present invention provides such a device, termed a totalizer, which will keep track of all cash which has been actually received by the machine for the dispensing of goods. The totalizer herein in its most preferred form has a non-resettable read-out so that the effects of tampering are kept to a minimum.

BRIEF DESCRIPTION OF THE DISCLOSURE

This invention discloses a totalizer suitable for use with a multiprice vending machine to record the total value of sales made. The totalizer includes means for scanning in a predetermined sequence a plurality of lines of a multiprice vending machine to detect a signal indicative of the value of the item selected, means for confirming that a sale (vend) has been made and means for registering the value of all sales made, by adding the cash value of the detected signal to the count in the register if a sale has in fact been made.

In the preferred embodiment shown, vending machine price wires are sampled a plurality of times so as to insure that there is one and only one signal on the price wires. This is very important to do in practice with the present day vending machines because of elements, e.g., relays, which are likely to produce extraneous electrical signals which may be misinterpreted as a sale. Similarily, the vending machine is preferably sampled a multiple number of times to confirm that a sale has in fact been made because of noisy electrical conditions.

The preferred embodiment also includes means for resetting portions of the totalizer in the event that false signals were determined to be present on the price wires or sale or $\overline{\text{sale}}$ wires to prevent the storage of erroneous information.

DETAILED DESCRIPTION OF THE DISCLOSURE

The preferred form of the invention as disclosed herein is for example, adapted to be directly coupled to the Vendo®, Visi.Vend® Automatic Food Venders shown in the Service Manual for the Visi.Vend® Automatic Food Venders, literature part No. 361,777, published by The Vendo Company, 999 Corrington Avenue, Kansas City, Missouri, U.S.A., and © 1971. The Visi.Vend® Machine comprises various models designated as VA3, VB1, VD1 and VBD1, and are further identified by Nos. 13C0132ZA, etc. Model No. VA3-13CP132ZA identifies in particular a frozen dessert vending machine which is of the front load type with standard styling.

Figure 1:
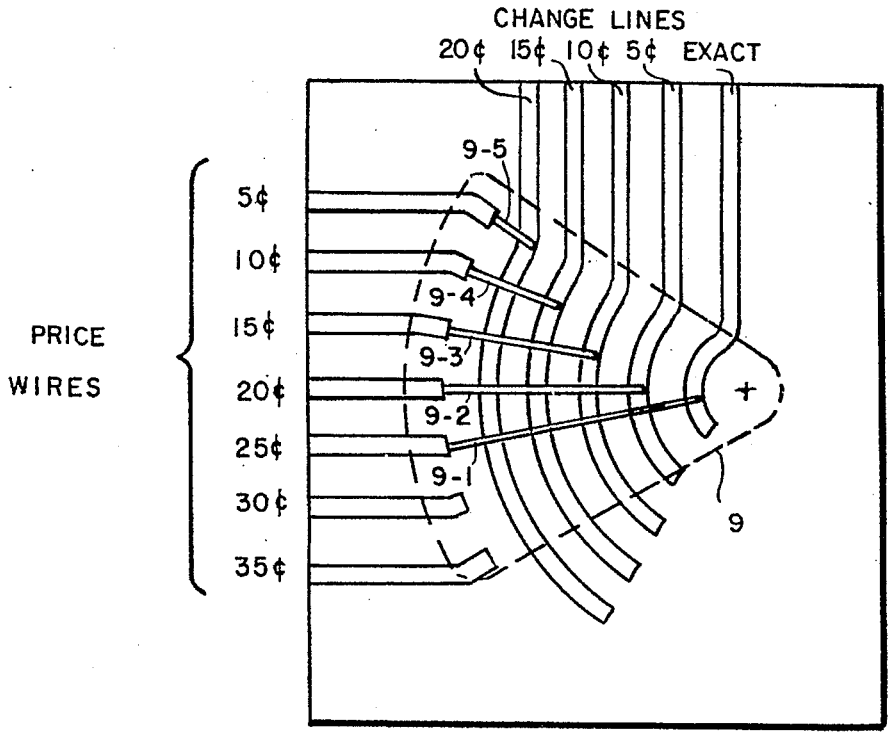
FIG. 1 is a diagrammatic view of a typical price board of a multiprice vending machine.
Figure 2:
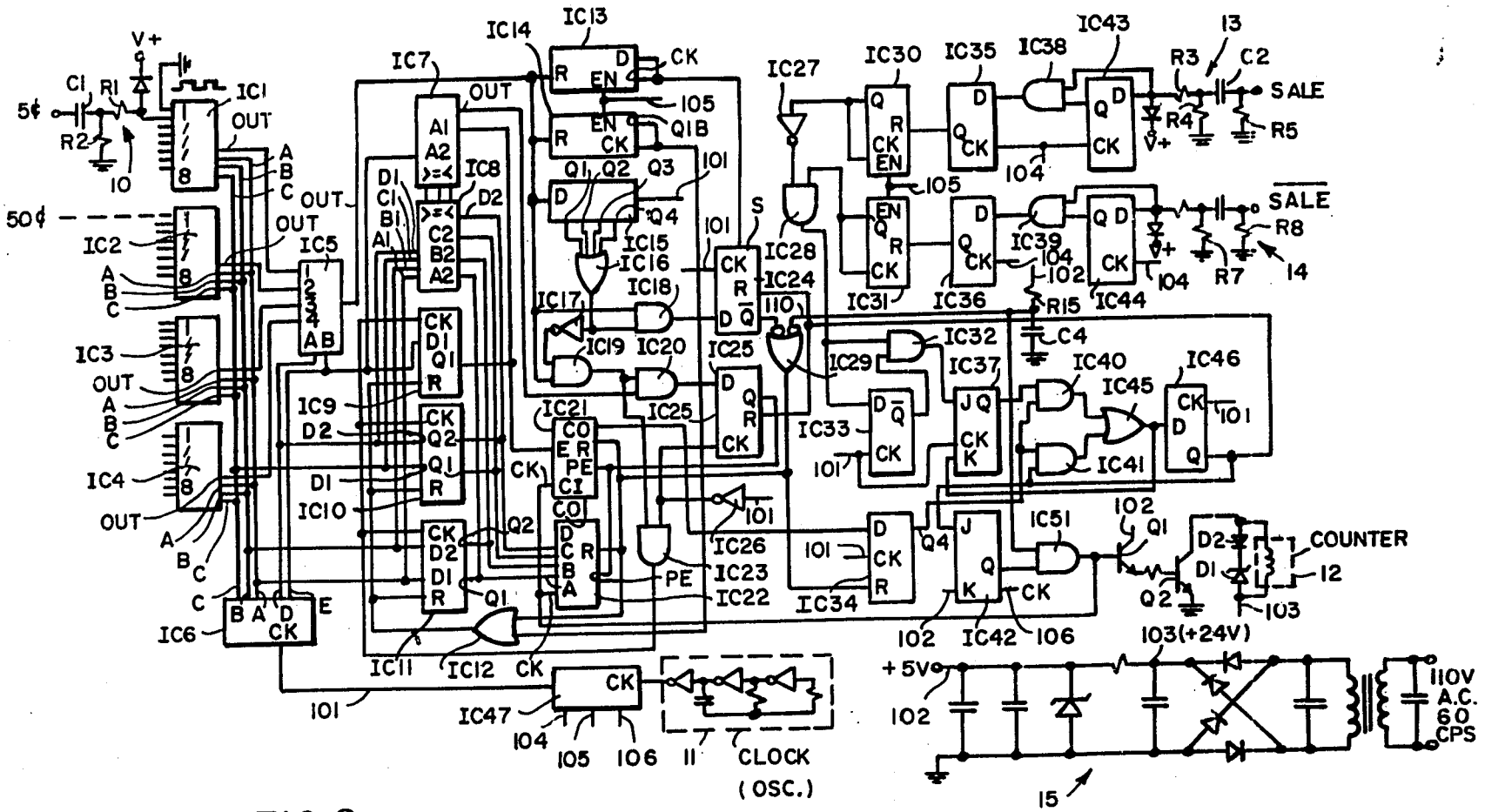
FIG. 2 is a logic diagram partially in schematic form showing the preferred embodiment of the disclosure.

This type of multiprice vending machine, as well as many other manufacturer's multiprice vending machines, includes a price board of the type which is diagrammatically shown in FIG. 1. The stepper part 9 shown by the dotted line moves counterclockwise one position every time a nickel is inserted in the vending machine coin mechanism. It moves two positions when a dime is inserted and five positions when a quarter is inserted. In FIG. 1, there is shown the position of the stepper part 9 when a quarter (25¢) has been inserted into the machine.

If an item with a 25¢ price is selected a signal will appear on the 25¢ price wire and travel through the movable switch connection 9-1 supported by 9 to the exact amount wire and no change will be given by the machine. If an item with a 15¢ price is selected by the user, pressing a select button, a signal will appear on the 15¢ wire through switch connection 9-3 also supported by 9 and the machine will give back 10¢.

In both cases a signal corresponding to the vend price of the item selected, regardless of the amount of change returned, is available on one of the price wires. Thus it is possible by sensing the price wires each time a vend is made to ascertain exactly how much the vend was made for.

In the Vendo® machine, of the type described above, there are thirty two price wires (representing 0¢ to $1.55) available for sensing and they will provide price information based on signals appearing on these price wires upon selection of an item by a customer.

Only one price wire at a time will provide a signal indicating the value of the selection made. In the Visi.-Vend® model, the signals which appear on the price wires are 110V AC at 60HZ.

In this invention the price wires are sequentially scanned in a predetermined order by Data Selectors (multiplexers) IC1, IC2, IC3, and IC4 which are themselves sequentially scanned by a Data Selector (multiplexer) IC5. It should be noted in this preferred embodiment the "0" price wire does not have to be scanned and thus the first input to the selector is grounded and the 5¢ price wire is coupled to the second input pin No. 2 of IC1.

The Data Selectors IC1 to IC5 have eight input channels and three binary control inputs A, B, C and an output line. Binary control input signals on lines A, B, C causes the price lines 5¢ to $1.55 (31 price wires or lines) to be sensed in a predetermined sequence by stepping the multiplexer through its sensing routine or sequence.

A suitable eight channel selector for this invention is the SCL 4512A sold by Solid State Scientific Inc. Montgomeryville, Pennsylvania U.S.A. See the book entitled CMOS Integrated Circuits distributed by Solid State Scientific Devices for a description of the "SCL" designated devices described herein.

The input signals provided to each of the input channels (pins 1 to 7, and 9) of each of IC1-IC4 are each coupled to the price wires by a resistor-capacitor-diode wave shaping network 10 comprising capacitor $C_1$, resistors $R_1$ and $R_2$, and diode $D_1$ coupled to V∓ (+5 v). This network is used to reduce the 110 V input signals to a maximum level (+5 v) which can be handled by the logic of the data selector. The input signal at each of the inputs is substantially a square wave of between 0 to +5 volts. It should be understood that 110 V signal is only present on the price wire representing the value of the item selected by the customer when the machine is ready to dispense an item.

When the SCL 4512A is used as the data selector pins 10 and 15 thereof are grounded and the Z (pin 14) output is the output of the selector. In addition, pins 11, 12 and 13 represent the A, B, and C control lines.

In this totalizer system, the data selectors IC1-IC5 combined with IC6 (an eight bit up counter) transform the 5¢ to $1.55 price wire inputs to a five bit binary code. A suitable counter which may be used as IC6 is the SCl 4520A in which both four bit counters are cascaded into an eight bit counter. The counter IC6 provides scanning control signals A, B, and C at pins 5, 4, 3 respectively, at the high speed clock rate provided to it on line 101.

The A and B inputs to IC5 are derived from pins 6 and 11 of IC6 with pin 6 being coupled to pin 10 and are also provided in response to the high speed clock signal on line 101. The high speed clock signal on line 101 is supplied by a frequency divider IC47 clocked by a conventional oscillator 11 providing clock pulses (preferably square waves) at a e.g., 40KHZ clock signal rate. Obviously, the clock frequency is not critical and may be varied so long as their is sufficient time to complete the scanning sequence as will be apparent to those skilled in the art.

A suitable oscillator 11 comprises three inverters as shown with capacitor and resistors as shown connected together as an oscillator. Obviously, many conventional clocks e.g., free running multi-vibrators, well known in the art can be used in place of the oscillator shown. The charging and discharging of the capacitor of oscillator 11 causes the clock signal to be provided at the output thereof.

The output master clock signal is then provided to the frequency divider IC47 (e.g., SCL 4040A) which provides a divide by a 2 signal (20KHZ) at pin 9 (line 101), a divide by 64 signal at pin 2 (line 104), a divide by 128 signal at pin 4 (line 105), a divide by 2048 signal at pin 15 (line 106).

The sequencing of IC1-IC4 by IC6 signals from A, B and C outputs produce a high output (+5 v) from only one of IC1-IC4 when a price line or wire goes high. A low output for the purpose of this system is OV (logical "0") and a high output is +5 v (logical "1") for the digital portion of this system. The price wire goes high when it has a 100 V AC signal on it.

The outputs from IC1-IC4 is sampled by data selector IC5 which is clocked by D and E outputs from IC6 so that it selects one of IC1-IC4 outputs during each complete scan through all 32 inputs of IC1-IC4. Because of the clocking of IC5, the 32 inputs are in fact scanned in sequence 1 to 32 and appear at the output of IC5 in that sequence.

The output from IC5 will only be a square wave (a high output) when the price line it is sampling at that time is high (has an analog signal e.g., 110 V 60 cps thereon indicating the selection of an item) and thus there is an unambiguous output representative at the time a price signal is detected with respect to IC6 clock, i.e., the value in counter IC6.

To generate the price or value of sale information, the counter IC6 value at the time a price wire is detected as going high is stored by data flip-flops IC9, IC10 and IC11 (e.g., type SCL 4013A). These flip-flops are constantly or continually reset to zero by a counter IC1-4(e.g., ½ SCL 4520A dual counter) during every scan unless IC5 produces a high output.

The data flip-flops IC9-IC11 are continually held in a reset condition by the action of $Q_{1B}$ output of IC14 (pin 12 if a SCL 4520A is used) which is high unless a high signal at IC5 resets IC14 ($Q_{1B}$ to 0). When this occurs IC14 no longer resets IC9 to IC11 and they are now ready to receive data.

IC14 remains in this condition for two scans through the 1-32 inputs of the data selectors IC1-IC4. Thus the count of IC6 representing the value of the price sensed on the price wire which is high is ready to be clocked into IC9-IC11. The clock pulse to clock in this data is controlled by IC5. A 4 stage shift register (e.g., an SCL 4015A) acts to detect if more than one price wire is high during a single scan. This would indicate an invalid signal which would in turn reset flip-flops IC9-IC11 through F/F IC24 (e.g., ½ SCL 4013A).

IC24 is normally being set by a 4 bit up counter IC13 (e.g., SCL 4520A) so that IC34, IC21 and IC22 are reset unless a high signal appears at the output of IC5. If no invalid signal is detected by IC15, then the output from IC5 enables AND circuit IC23 to permit IC9-IC11 to be clocked by a single pulse from line 101 (inverted). Thus the data from counter IC6 is stored in IC9-11.

When the totalizer is initially energized +5 v (DC) appears at 102. However, because of R15 and C4 no voltage appears initially on line 110 and this causes a reset pulse to be provided to IC9-IC11 and data flip-flop IC34 to reset them through NAND gate IC29. By resetting IC9-IC11 and IC34 an erroneous count is prevented when the power is turned on. In addition, the signal on line 110 is provided to AND IC51 to likewise prevent erroneous pulses from IC42 from activating counter 12 when the power is turned on.

On the second pass through the 2-32 price wires, the outputs from IC9-IC11 which are now storing the price value which was detected during the first pass are compared against counter value IC6 by 4 bit magnitude comparators IC7 and IC8 (e.g., SCL 4585A). If the value of IC6 is the same on the first and second passes, the comparator IC7 output goes high and is ANDed in IC20 (AND) with the output of IC19 (AND). When this occurs the Q output of a data flip-flop IC25 (e.g., SCL 4013A) goes high on the next clock pulse provided on line 101 through inverter IC26.

The Q output of IC25 feeds into the preset enable (PE) inputs of up down counters IC21 and IC22 (e.g. SCL 4516A). This allows the values in IC9-IC11 to be stored in IC21 and IC22. If output from IC7 does not go high on the second pass at the same time as IC5, then IC21 and IC22 are not enabled and no data is stored in these counters.

At this time, assuming that the counters IC21 and IC22 have a valid price wire value stored therein, they are now waiting for a valid sale signal. A $\overline{\text{sale}}$ is also detected from the vending machine and indicates that no sale is occuring (a vend or sale is not being or has not been made). If a $\overline{\text{sale}}$ is detected, this signal is used to hold off the sale signal from causing the value in IC21 and IC22 to be stored in a conventional signal step counter 12 (e.g., ENM Model E 2B65DF05—see U.S. Pat. No. 3,470,361).

If the sale line goes high, the sale signal, which indicates a vend, is coupled to data flip-flop IC43 (e.g., SCL 4013A) to cause its Q output to go high at clock time 104.

The Q output from IC43 is ANDed in IC38 with the shaped sale signal (a +5 v square wave) which then is fed into the input of data flip-flop IC35 (e.g., SCL 4013A). The output Q from IC35 resets IC30 a four bit counter (e.g., SCL 4520A) when a sale signal is present. Therefore the Q output of IC30 goes to zero and is inverted by IC27 and is fed through IC28 and into data flip-flop IC33 (e.g., SCL 4013A).

It should be understood that the IC30 connected as shown is arranged to count to 8 and cease counting which produces a high signal at the Q output. If the counter is reset before it reaches a count of eight which is continually occurring if an AC signal is applied to the sale input, the Q output will remain low. Thus IC30 provides a low DC level indicative of the presence of an AC signal on the sale input line.

The AC $\overline{\text{sale}}$ signal (if present) is also shaped to provide +5 v square wave which triggers a data flip-flop IC44. The Q output of IC44 is ANDed in IC39 with the square wave input to IC44 to trigger data flip-flop IC36 which in turn resets a 4 bit counter IC31 which operates in the same manner and is the same type of counter as IC30 as described above to produce an inhibit signal at IC28 when Q goes low.

AND circuit IC32 combines with IC33 to give a pulse output when there is a sale signal and no $\overline{\text{sale}}$ is present. The output from IC32 is provided to a J input of JK flip-flop IC37 (e.g., SCL 4024B) which allows the Q output of IC37 to go high (+5v).

The output from IC37 is ANDed with IC34 output $Q_4$ of a four stage static register, e.g., ½ of an SCL 4015A. The input to IC34 is derived from IC21 carryout which goes high when IC21 or IC22 have a vend or sale price value stored in them. It should be understood that IC21 and IC22 together make up an 8 bit counter storing the value of the sale or vend.

The ANDing of the output ($Q_4$) IC34 and IC37 in AND IC40 is stored in IC46 a data flip-flop at clock time 101 indicating the machine has made a sale or vend and the value of same is stored in IC21 and IC22.

Since the output from IC37 is only a pulse, IC46 a data flip-flop latches itself through AND IC41 and OR IC45. The Q output signal from IC46 causes three events to occur: (1) IC24 is reset so that counters IC21, IC22 and IC34 will not be reset because of IC13 acting on the set input of IC24. This setting of IC24 would occur through the next scan if the price line went low via IC13; (2) IC25 is reset so that IC21 and IC22 will not be preset enabled during the count sequence; and (3) the IC42 J input goes high which causes IC42 Q output to toggle at the clock frequency on line 106 (20HZ).

This output is gated through IC51 to drive transistors $Q_1$ and $Q_2$ to cause the counter 12 to count and also causes counters IC21 and IC22 to count down to zero. JK flip-flop IC42 toggles until the values in IC21 and IC22 have been clocked down to zero at which time carryout of IC21 goes to zero which causes IC34 $Q_4$ output to go to zero and IC46 output to go to zero through the gates IC41 and IC45 which causes IC42 to cease toggling.

Thus the counter 12 has had added to it the sensed and decoded value of the vend or sale. The $\overline{\text{sale}}$ (not sale) signal in the case of the Visi Vend® A Model 14C—cold food model is provided from the T-9 pin from the stepper board and the pin 14 (wire 14A) to the pricing board provides the sale signal.

It should be noted that the sale and $\overline{\text{sale}}$ signals are preferably sampled at least twice by the clock signals appearing on line 104 so that erroneous signals are avoided by relying on the first sample to generate the Q signal from IC43 and the second sample which is ANDed with the Q of IC43 to generate the Q output of IC35.

It should be understood that shaping circuits 13 and 14 are coupled to the inputs of IC43 and IC44 to convert the 110 AC 60 cps signals to +5 v peak square wave signals for operating same. At 15 there is shown a conventional power supply for providing DC levels at lines 102 (+5 v) and 103 (+24 v) as used in this invention. It should be understood tht in some vending machines the input signals e.g., sale, $\overline{\text{sale}}$ and price wire select signals may be at DC levels and thus different types of conventional input shaping circuits are provided to derive the voltage required for the logic.

In addition, it should be understood that the $\overline{\text{sale}}$ or sale signal is not available from some vending machines and thus will be disconnected and either the sale or $\overline{\text{sale}}$ signal will be the controlling factor to indicate a vend. For example, in some machines the CREM relay action may be used to develop a signal to indicate a sale to cause the count to be made by counter 12.

It should also be understood that the Solid State Scientific Inc. devices shown merely illustrate suitable purchaseable logic devices for accomplishing the present invention and its designation herein is not meant to be limiting as will be apparent to those skilled in the art.

The power to the IC's shown is provided from line 102 (+5 u). Clock time as used herein refers to the signal on lines 101, 104, 105 and 106 and the logic used herein is responsive to a low to high transition for switching.

In this system if the flip-flops designated herein as being useful for implementing this system are employed, it should be understood that the unused inputs should be grounded.

It will thus be apparent to those skilled in the art that the present invention is universally applicable to machines of manufacturers such as National, Rowe and others.

I claim:

1. A totalizer for use with a multi-price vending machine for vending items and having a plurality of price wires which carry a signal representing the value of an item selected by the user of the vending machine and a device for providing a control signal indicating the sale of the item, said totalizer comprising first means for respectively scanning said wires to detect a value of sale signal, second means for storing the value of sale signal detected, and third means responsive to the control signal for controlling the storage of the value of the sale signal in said second means, said first means comprises a data selector means coupled to said price wires, a first counter for providing signals to said data selector for causing same to scan said price wires, clock means for clocking said first counter, first storage means for storing the count of the first counter after a first detection of a value of sale signal by said data selector, and comparator means responsive to the count in said first counter after the second detection of a value of sale signal by said data selector and the count stored in said storage means for generating a comparison valid signal indicating valid valie value of sale signal has been detected.

2. The totalizer of claim 1 in which said second means comprises second storage means for storing a detected value of sale signal in response to said comparison valid signal.

3. The totalizer of claim 1 wherein said second means comprises a second counter for summing the value of all sales.

4. The totalizer of claim 3 in which said second means comprises toggle means responsive to said value signal and said sale signal for providing signals to step the second counter.

5. The totalizer of claim 1 in which said second means comprises means for resetting said first storage means if a value of sale signal is detected on more than one price wire during scan scal of said price wires.

6. The totalizer of claim 5 in which said third means comprises means responsive to a sale signal for generating an inhibit signal to block the storage of said valve of sale signal in said second counter.

7. The totalizer of claim 6 in which said second means comprises a third counter for accumulating the dollar value of all sales made.

8. The method of determining the value of a sale made by a multi-price vending machine which comprises the step of scanning a set of price lines a plurality of times to determine the value of the item sold, verifying the value of the item sold and then storing said value.

9. The method of claim 8 in which the value of the item sold is converted to a binary code.

10. A totalizer comprising first means for scanning a plurality of price lines in a vending machine to provide a coded signal representing the price value of an item selected from the vending machine, said first means responsive to the presence of a signal on a price line to generate a code representing the price line sensed as having a signal thereon, means for storing said coded signal, and said first means sequentially scans the price wires of the vending machine to derive said coded signal.

11. The totalizer of claim 10 in which said means for storing includes a counter which totals the value of all sales made.

12. A totalizer for use with a multi-price vending machine for vending items and having a plurality of price wires which carry a signal indicative of the value of an item selected by the user of the vending machine and a device for providing a control signal indicating the sale of the item, said totalizer comprising first means for scanning said price wires to detect a value of sale signal, second means for storing the value of sale signal, and third means responsive to the control signal for controlling the storage of the value of the sale signal in said second means, said first means include means for scanning said price wires a plurality of times to verify that an item selected has the same value as indicated on a preceding scanning pass.

13. A totalizer for use with a multi-price vending machine for vending items and having a plurality of price wires which carry a signal indicative of the value of the item selected by the user of the vending machine and a device for providing a control signal indicating the sale of an item, said totalizer comprising first means for scanning said price wires to detect a value of sale signal, second means for storing the value of sale signal, and third means responsive to the control signal for controlling the storage of the value of the sale signal in said second means, said first means comprises data selector means coupled to said price wires, a counter for providing signals to said data selector for causing same to scan said price wires, and clock means for clocking said counter means.

* * * * *